US007337757B2

(12) United States Patent
Schmidt et al.

(10) Patent No.: US 7,337,757 B2
(45) Date of Patent: Mar. 4, 2008

(54) CARBURETOR ARRANGEMENT FOR AN INTERNAL COMBUSTION ENGINE

(75) Inventors: Olaf Schmidt, Korb (DE); Andreas Schulz, Stuttgart (DE); Jan Kurzenberger, Köngen (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 0 days.

(21) Appl. No.: 11/723,983

(22) Filed: Mar. 23, 2007

(65) Prior Publication Data

US 2007/0221158 A1 Sep. 27, 2007

(30) Foreign Application Priority Data

Mar. 23, 2006 (DE) ..... 10 2006 013 339

(51) Int. Cl.
*F02M 1/02* (2006.01)

(52) U.S. Cl. ..... 123/179.16; 261/64.6

(58) Field of Classification Search ..... 123/179.16, 123/179.18; 261/52, 64.6
See application file for complete search history.

(56) References Cited

U.S. PATENT DOCUMENTS 4,079,708 A 3/1978 Wieland et al.
4,137,283 A * 1/1979 Couderc ..... 261/52
5,215,049 A * 6/1993 Wolf ..... 123/179.18
5,693,264 A * 12/1997 Fricke ..... 261/64.6
6,202,989 B1 * 3/2001 Pattullo ..... 261/52
6,494,439 B1 * 12/2002 Collins ..... 261/52
6,550,749 B2 * 4/2003 Vick ..... 261/52
6,561,496 B2 * 5/2003 Gliniecki et al. ..... 261/52
6,871,623 B2 * 3/2005 Ohsawa et al. ..... 123/179.18
6,896,245 B2 * 5/2005 Suzuki et al. ..... 261/52
6,957,633 B2 * 10/2005 Toda et al. ..... 123/179.18

* cited by examiner

*Primary Examiner*—Stephen K. Cronin
*Assistant Examiner*—Arnold Castro
(74) *Attorney, Agent, or Firm*—Walter Ottesen

(57) ABSTRACT

A carburetor (1) for an internal combustion engine has an intake channel section (3) wherein a throttle element and a choke element are supported to pivot about respective rotational axes (34, 35). The carburetor (1) has a starter unit which has an operating position, an off position and at least one start position. In the start position, the starter unit fixes defined positions of the throttle element and the choke element. A simple manipulability and a multifaceted operational use of the carburetor (1) are achieved when the starter unit includes an actuating lever (29, 69) and an intermediate lever (18, 68) having respective rotational axes (28, 37) which are at a distance (c) to each other at least at the elevation of the intermediate lever (18, 68) and when the actuating lever (29, 69) acts on the throttle element via the intermediate lever (18, 68).

23 Claims, 7 Drawing Sheets

CARBURETOR ARRANGEMENT FOR AN INTERNAL COMBUSTION ENGINE

CROSS REFERENCE TO RELATED APPLICATION

This application claims priority of German patent application no. 10 2006 013 339.0, filed Mar. 23, 2006, the entire content of which is incorporated herein by reference.

FIELD OF THE INVENTION

The invention relates to a carburetor arrangement for an internal combustion engine. The carburetor arrangement has an intake channel wherein a throttle element and a choke element are pivotally supported about respective rotational axes. The carburetor arrangement also includes a starter unit which has an operating position, an off position and at least one start position. In the start position, the starter unit fixes defined positions of the throttle element and of the choke element.

BACKGROUND OF THE INVENTION

A carburetor arrangement having a starter unit is disclosed in U.S. Pat. No. 4,079,708 wherein the positions of a choke element and a throttle element can be adjusted via a control shaft. The control shaft acts via a linkage on the choke element. The control shaft acts on the throttle linkage to fix the position of the throttle element and the throttle linkage connects the throttle lever to the throttle element.

A precise transmission of the position movement of the control shaft on the throttle element is possible via a linkage when the throttle lever and the carburetor are arranged with respect to each other in defined positions. In work apparatus wherein the carburetor is fixedly connected to the internal combustion engine and wherein the connection of the control shaft and the choke element must bridge a vibration gap, an adjustment of the start position via a gas linkage is imprecise.

SUMMARY OF THE INVENTION

It is an object of the invention to provide a carburetor arrangement for an internal combustion engine of the kind described above wherein a simple and precise setting of the start position is provided and wherein the carburetor arrangement has a multifaceted utility.

The carburetor arrangement of the invention is for an internal combustion engine and includes: a carburetor defining an intake channel; a throttle element pivotally mounted in the intake channel to pivot about a first rotational axis; a choke element pivotally mounted in the intake channel to pivot about a second rotational axis; a starter unit having an off position, at least one start position and an operating position; the starter unit determining defined positions of the throttle element and the choke element in the start position; the starter unit including an actuating lever for actuating the starter unit; the actuating lever defining a third rotational axis; the starter unit further including an intermediate lever defining a fourth rotational axis; the third rotational axis and the fourth rotational axis being at a distance (c) to each other at least at the elevation of the intermediate lever; and, the actuating lever being operatively connected to the throttle element via the intermediate lever so as to operate on the throttle element.

The actuation of the throttle element via the actuating lever and the intermediate lever is independent of a coupling element between the throttle lever and the throttle element. In this way, the starter unit can be used in a multifaceted manner. A simple operation of the starter unit is ensured because the starter unit fixes the position of the throttle element and the choke element in the start position. The rotational axes of the actuating lever and the intermediate lever lie at a spacing to each other so that a coupling of the movements of the levers is possible. Especially when the rotational axes are arranged at angles to each other, it is important that the rotational axes are at a distance with respect to each other at the elevation of the intermediate lever. The rotational axes can intersect at an axial distance to the intermediate lever.

Advantageously, the rotational axis of the intermediate lever is at a distance to the rotational axis of the throttle element and to the rotational axis of the choke element. The carburetor is especially mounted on a carrier component on which the intermediate lever and the actuating lever are supported. In this way, a simple and compact assembly of the carburetor arrangement is provided. The position of the actuating lever and the intermediate lever to each other as well as to the throttle element and choke element is constructively pregiven so that, for example, no changes of the relative positions with respect to each other result because of vibrations during operation. In this way, the start position can be precisely set. The influence of tolerances then is compensated by a one-time setting. The starter unit fixes a warm-start position and a cold-start position of throttle flap and choke element. In this way, the operator can select in a simple manner the start position suitable for the particular operating state. Because the warm-start position is provided, the situation is avoided that too much fuel is supplied with renewed starting of the engine which excess fuel could hinder a combustion in the combustion chamber.

Each position of the intermediate lever is assigned a defined position of the throttle element. Accordingly, the intermediate lever is coupled to the position of the throttle element in each position thereof. A movement of the throttle element without a movement of the intermediate lever is not possible. In order to achieve this, the intermediate lever advantageously has a fork or bifurcated element aligned radially to the rotational axis of the intermediate lever. A pin connected to the throttle element projects into this fork. The fork effects a coupling of the intermediate lever to the position of the throttle element in both directions of movement of the throttle element.

To set the start position, the intermediate lever has a guide piece which lies against a guide of the actuating lever in the start position. The start position of the throttle element can be constructively adapted in a simple manner via the configuration of the guide. The starter unit fixes a warm-start position and the actuating lever has a stop against which the guide piece lies in the warm-start position and the actuating lever and the guide piece define a catch or detent position. The catch position ensures a defined warm-start position of the throttle element and especially also of the choke element. At the same time, a release of the latching is achieved via actuation of the throttle element. A choke actuation is advantageously provided on the actuating lever which acts on the choke element in the start position of the starter unit. The position of the choke element is thereby directly dependent upon the position of the starter unit. In this way, the different positions of the choke element in the warm-start position and cold-start position can be constructively pregiven in a simple manner.

The position of the intermediate lever is coupled to the position of the actuating lever in each position of the intermediate lever. The position of the throttle element can be decoupled from the position of the intermediate lever. Advantageously, the position of the intermediate lever is coupled to the position of the actuating lever via a pin guided in a guide slot. The pin can be mounted especially on the actuating lever. However, the pin can also be arranged on the intermediate lever. In order to obtain a good guidance, the lever on which the guide slot is formed is configured as two parts and the other lever, which carries the pin, is mounted between the two parts of the lever. Especially, the lever with the pin is coupled to the two part lever via the guide slot. Advantageously, two pins are provided which are mounted on both ends of the centrally guided lever and which each project into a guide slot of a part of the divided lever. In this way, a uniform guidance is obtained. The transmission system of actuating lever and intermediate lever is stabilized. Advantageously, the intermediate lever has an arm which coacts with an arm connected to the throttle element. Because of the coupling via two arms, it is possible to provide a coupling of the intermediate lever and the throttle element in pregiven positions of the intermediate lever and, in other positions of the intermediate lever, to permit a decoupled movement of the throttle flap. The configuration of two arms can be constructively simple.

Advantageously, the arms of the throttle element and the intermediate element determine a catch position in the warm-start position to which a defined position of the throttle element is assigned. The catch position can furthermore determine a defined position of the choke element. A release of the engagement can be achieved especially via actuation of the throttle element.

The carburetor arrangement has a contact spring to provide an electrically conductive connection with the ignition of the engine. The contact spring advantageously lies on the actuating lever and the actuating lever has a contact element which contacts the contact spring in the off position of the starter unit. The contact between the contact spring and the contact element is dependent upon the position of the starter unit because the contact element is arranged on the actuating lever. In this way, the situation is achieved in a simple manner that, in the off position of the starter unit, the contact element makes contact and the ignition is thereby grounded. In this way, an ignition in the off position of the starter unit is reliably avoided.

It can also be provided that the actuating lever is fixed to the control shaft and that the contact spring lies against the control shaft. The control shaft especially has a contact element which contacts the contact spring in the off position of the starter unit. Also, for an arrangement of the contact element on the control shaft, the contacting between the contact spring and contact element is dependent upon the position of the starter unit. In this way too, an ignition in the off position of the starter unit can be reliably avoided.

In the warm-start position, the contact spring biases the actuating lever in a direction toward its operating position. Especially, with the pivoting of the throttle element in a direction toward its full-load position, the actuating lever is released and the starter unit pivots out of the warm-start position into the operating position. The contact spring ensures that with the first application of the throttle after starting the engine, the catch between the actuating lever and the intermediate lever is released so that the actuating lever pivots into its operating position. In this way, the choke element is also transferred into its operating position. Because of the spring bias of the actuating lever, a return pivot of the starter unit into the operating position is ensured without further action of the operator. In this way, the manipulation is simplified. Advantageously, the actuating lever is biased in the cold-start position by the contact spring in a direction of movement opposite to that of the warm-start position. The position of the actuating lever is advantageously defined by a stop. The contact spring thereby ensures that the actuating lever lies against the stop. In this way, a defined position of the actuating lever and therefore of the choke element and of the throttle element is achieved in the cold-start position. The contact spring thereby ensures the cold-start position as well as the warm-start position. Since the spring load takes place via the contact spring, which is anyway present, no additional components are needed for this purpose.

The actuating lever is advantageously fixed on a control shaft having a rotational axis which extends transversely to the flow direction in the intake channel section. The throttle element is especially actuated via a bowden cable which is connected to the throttle element at the end of the carburetor lying opposite to the actuating lever. With the actuation of the throttle element via the bowden cable, the carburetor can be mounted in a space substantially screened off from the ambient. The inlet opening of the bowden cable can be sealed off in a simple manner via a rubber grommet or the like. In this way, contamination of the carburetor is prevented which could otherwise affect the function thereof. With the arrangement of the bowden cable on the end of the carburetor lying opposite to the actuating lever, adequate structural space is available for the starter unit as well as for the bowden cable. A negative effect on the function of the starter unit by the bowden cable is avoided.

Advantageously, the intermediate lever blocks the actuation of the starter unit in the operating position of the starter unit and in the idle position of the throttle element. In this way, it can be avoided that the operator inadvertently actuates the starter unit during idle of the engine. Advantageously, the intermediate lever has a latch hook which coacts with a latch lug on the actuating lever in the operating position of the starter unit and in the idle position of the throttle element. Blocking of the starter unit can be realized in a simple manner in this way without additional components.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
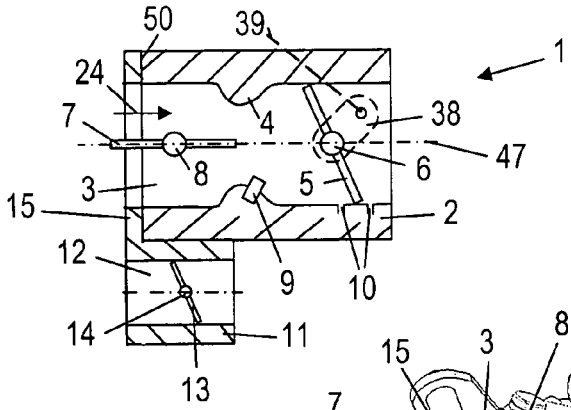
FIG. 1 is a schematic section view of a carburetor.

The carburetor 1 shown schematically in FIG. 1 has a carburetor housing 2 wherein an intake channel section 3 is formed. The intake channel section 3 is advantageously connected to the intake of an internal combustion engine, especially, in a portable handheld work apparatus such as a motor-driven chain saw, brushcutter or the like. The intake channel section 3 conducts the air/fuel mixture to the engine. A venturi 4 is formed in the intake channel section 3 and a main fuel port 9 opens into the intake channel section 3 in the region of the venturi 4. Referred to the flow direction 24, a throttle element in the form of a throttle flap 5 is pivotally journalled via a throttle shaft 6 downstream of the main fuel port 9. A lever 38 shown in phantom outline in FIG. 1 is attached to the throttle shaft 6 at the outer side of the carburetor housing 2 so as to rotate therewith. A bowden cable 39 acts on the lever 38. The bowden cable 39 is connected to a throttle lever for operating the internal combustion engine. Ancillary fuel outlets 10 open into the intake channel section 3 in the region of the throttle flap 5.

A choke flap 7 having a choke shaft 8 is pivotally journalled in the intake channel section 3 upstream of the throttle flap 5 and the venturi 4. As shown in FIG. 1, in the unactuated position of the throttle flap 5 and choke flap 7, the throttle flap 5 substantially closes the intake channel section 3. The choke flap 7 lies approximately parallel to a longitudinal center axis 47 of the intake channel section 3 and reduces the flow cross section in the intake channel section 3 only insignificantly.

An air channel housing 11 is fixed to the carburetor housing 2. The air channel housing 11 has a flange 15 which is mounted at an end face 50 of the carburetor housing 2 lying upstream. An air channel section 12 is formed in the air channel housing 11. An air flap 13 having an air flap shaft 14 is pivotally journalled in the air channel section 12. The position of the air flap 13 is advantageously coupled to the position of the throttle flap 5. A coupling between the position of the choke flap 7 and the air flap 13 can be provided which ensures that the air flap 13 is closed when the choke flap 7 is actuated.

A carburetor arrangement having a carburetor 1 is shown in FIGS. 2 to 11. The carburetor housing 2 is fixed to a carburetor carrier 53. A channel (not shown) runs in the carburetor carrier 53 and air for prewarming the carburetor is guided through this channel. A section of the intake channel and a section of the air channel are formed in the carburetor carrier 53.

The carburetor 1 has a starter unit with which defined positions of the choke flap 7 and the throttle flap 5 can be adjusted for a warm-start position and a cold-start position.

Figure 2:
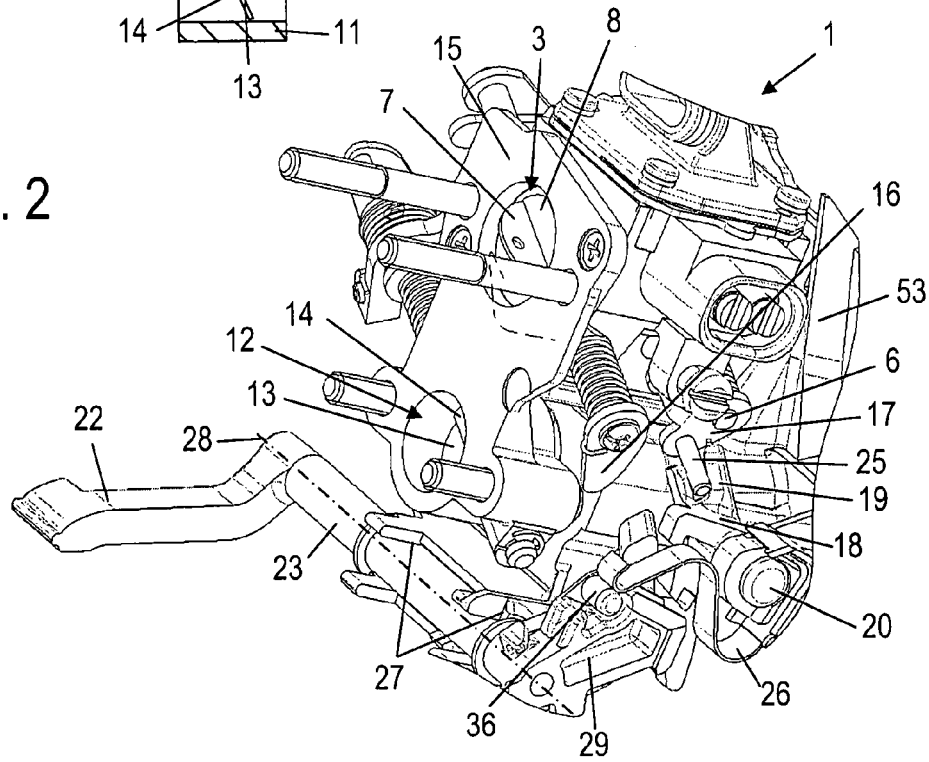
FIG. 2 is a perspective view of a carburetor arrangement having a starter unit in the off position.
Figure 3:
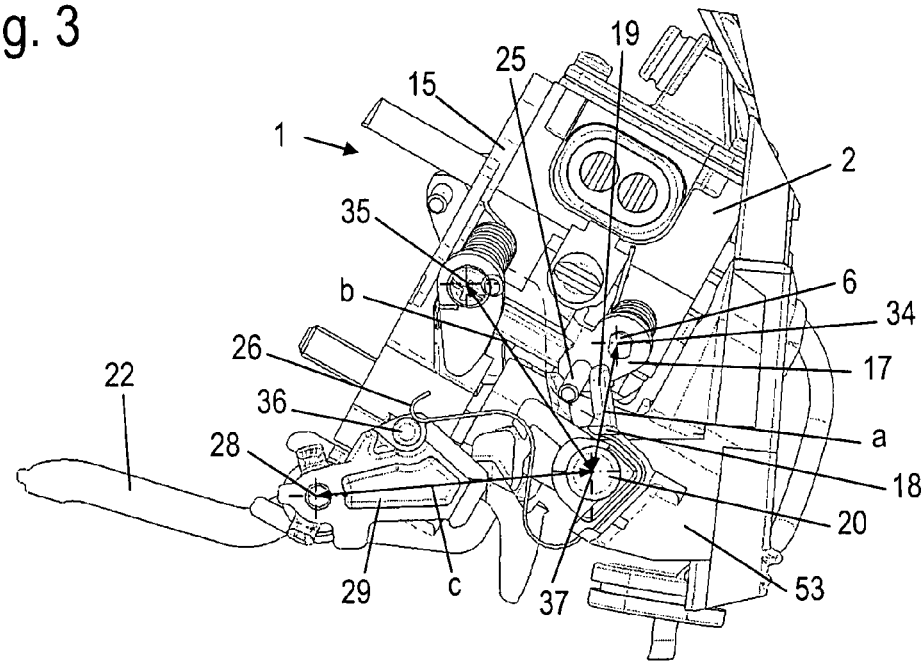
FIG. 3 is a side elevation view of the carburetor of FIG. 2 in the off position.

In FIGS. 2 and 3, the starter unit is shown in the off position. The starter unit has an operator-controlled lever 22 on which a control shaft 23 is mounted. The control shaft 23 is rotatably journalled at two bearing positions 27 on the carburetor carrier 53. On the end of the control shaft 23, which lies opposite the operator-controlled lever 22, an actuating lever 29 is mounted on the control shaft 23. The operator-controlled lever 22, the control shaft 23 and the actuating lever 29 are connected to each other so that they rotate together and are advantageously configured as one part.

A contact spring 26 is fixed on the carburetor carrier 53. In the off position shown in FIGS. 2 and 3, the contact spring 26 lies against a contact pin 36 and contacts the latter. The contact pin 36 is mounted on the actuating lever 29. The contact spring 26 is connected to an ignition of the internal combustion engine. The ignition of the internal combustion engine is short circuited via the contact pin 36 so that an ignition is avoided. The control shaft 23 and/or the contact spring 26 can also be supported on an adjacent component, for example, a tank housing. A support on the carburetor housing 2 is also possible. Advantageously, the support is on a component which is connected to the carburetor or is held on the carburetor 1.

An intermediate lever 18 having a shaft 20 is rotatably journalled about a rotational axis 37 on the carburetor carrier 53. The carburetor carrier 53 serves as a support for the control shaft 23, the intermediate lever 18 and the contact spring 26. As shown in FIG. 3, the rotational axis 37 of the intermediate lever 18 is at a distance (c) to a rotational axis 28 about which the control shaft 23 is pivotable with the actuating lever 29. The rotational axis 37 of the intermediate lever 18 has a distance (a) to the rotational axis 34 of the throttle shaft 6 and a distance (b) to the rotational axis 35 of the choke shaft 8. Accordingly, the actuating lever 29, the intermediate lever 18, the throttle shaft 6 and the choke shaft 8 are rotatable about different rotational axes.

In the embodiment, the rotational axes 28 and 37 of the actuating lever 29 and of the intermediate lever 18 are mounted parallel to each other. The rotational axes 34 and 35 of the choke shaft 8 and the throttle shaft 6 run parallel to each other and are inclined relative to the rotational axes 28 and 37. However, other arrangements of the angular positions of the rotational axes (28, 34, 35, 37) can also be advantageous.

A throttle lever 17 is fixed with a pin 25 on the throttle shaft 6 so as to rotate therewith. The pin 25 runs parallel to the rotational axis 34 of the throttle shaft 6 and is at a distance to the rotational axis 34. The intermediate lever 18 has a fork 19 into which the pin 25 projects. The bifurcated element or fork 19 engages at two opposite sides about the pin 25 so that with a rotation of the throttle shaft 6, the intermediate lever 18 is taken along in both rotational directions. On the choke shaft 8, a choke lever 16 is mounted and is connected so as to rotate with the choke shaft 8. In the off position of the starter unit shown in FIGS. 2 and 3, neither the intermediate lever 18 nor the choke lever 16 is actuated by the actuating lever 29. The throttle flap 5 and the choke flap 7 are disposed in positions shown in FIG. 1.

Figure 4:
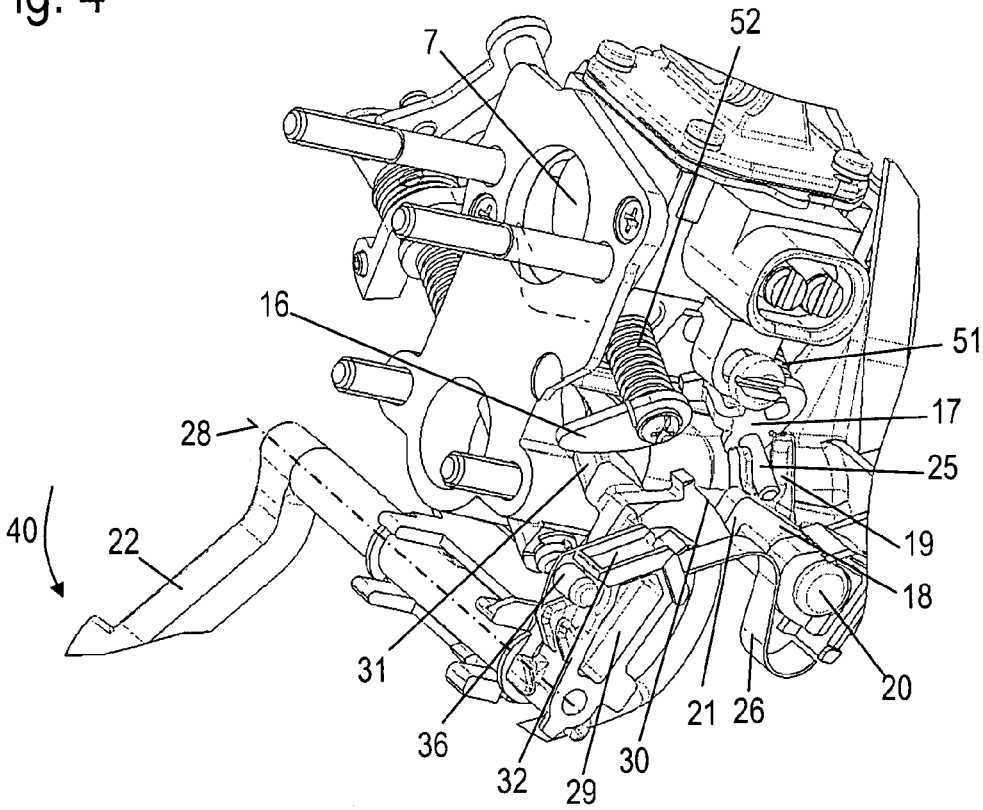
FIG. 4 is a perspective view of the carburetor arrangement in the cold-start position.
Figure 5:
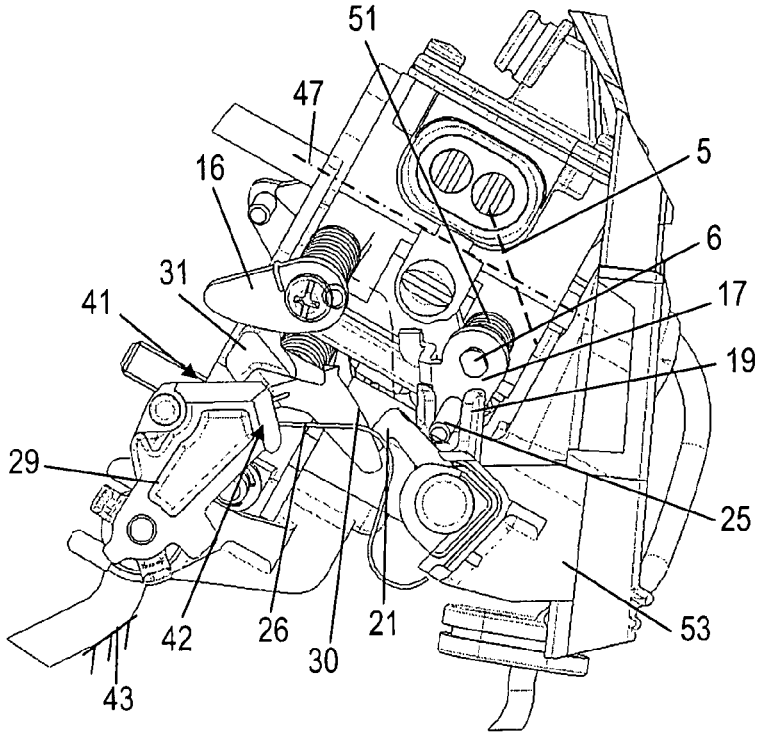
FIG. 5 is a side elevation view of the carburetor arrangement of FIG. 2 in the cold-start position.

For starting the internal combustion engine, the operator-controlled lever 22 is brought out of the off position shown in FIGS. 2 and 3 into the cold-start position shown in FIGS. 4 and 5. For this purpose, the operator-controlled lever 22 is pivoted in the direction of the arrow 40 shown in FIG. 4. With the pivoting of the operator-controlled lever 22, the contact spring 26 disengages from the contact pin 36 and slides on a slide surface 32 (FIG. 4) on the actuating lever 29. As shown in FIG. 5, the slide surface 32 has a first section 41 and a second section 42 which runs at an angle relative to the first section 41. In the movement out of the off position into the cold-start position, the contact spring 26 moves from the contact pin 36 first in the section 41 of the slide surface 32. If the operator moves the operator-controlled lever 22 further against the force of the contact spring 26, then the contact spring 26 moves to the second section 42 of the slide surface 32. After overcoming the discontinuity or sharp bend between the two sections (41, 42), the contact spring 26 biases the actuating lever 29 in FIG. 5 in the counterclockwise direction, that is, in the direction of arrow 40. The contact spring 26 presses the actuating lever 29 (that is, the operator-controlled lever 22) against a stop 43. In this way, the starter unit is reliably held in the cold-start position. The stop 43 can, for example, be configured on the carburetor carrier 53 or on the housing of the work apparatus itself.

The actuating lever 29 has a guide 30. A guide piece 21 of the intermediate lever 18 lies on the guide 30 in the cold-start position shown in FIGS. 4 and 5. In this way, the intermediate lever 18 is pivoted with the actuation of the operator-controlled lever 22 and entrains the pin 25. This leads to a partial opening of the throttle flap 5. The position of the throttle flap 5 is indicated by a broken line in FIG. 5. In the cold-start position, the throttle flap 5 is held inclined by a lesser angle to the longitudinal center axis 47 of the intake channel section 3 than in the off position.

A choke actuator 31 is provided on the actuating lever 29. The choke flap 7 is spring biased by a spring 52 in a direction toward the completely open position shown in FIG. 1. The choke actuator 31 actuates the choke lever 16 and closes the choke flap 7 against the force of the spring 52 (FIG. 4). The throttle flap 5 is spring biased toward its completely closed position shown in FIG. 1 by a spring 51. The opening of the throttle flap 5 via the intermediate lever 18 takes place against the force of the spring 51.

Figure 6:
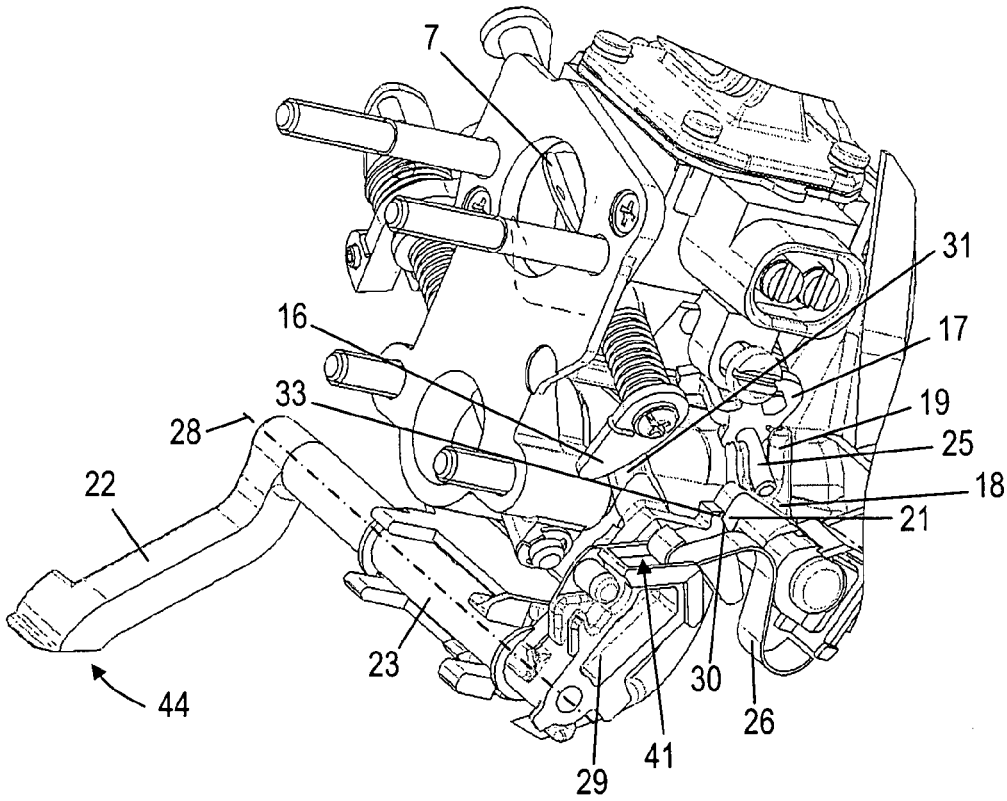
FIG. 6 is a perspective view of the carburetor arrangement of FIG. 2 in the warm-start position.
Figure 7:
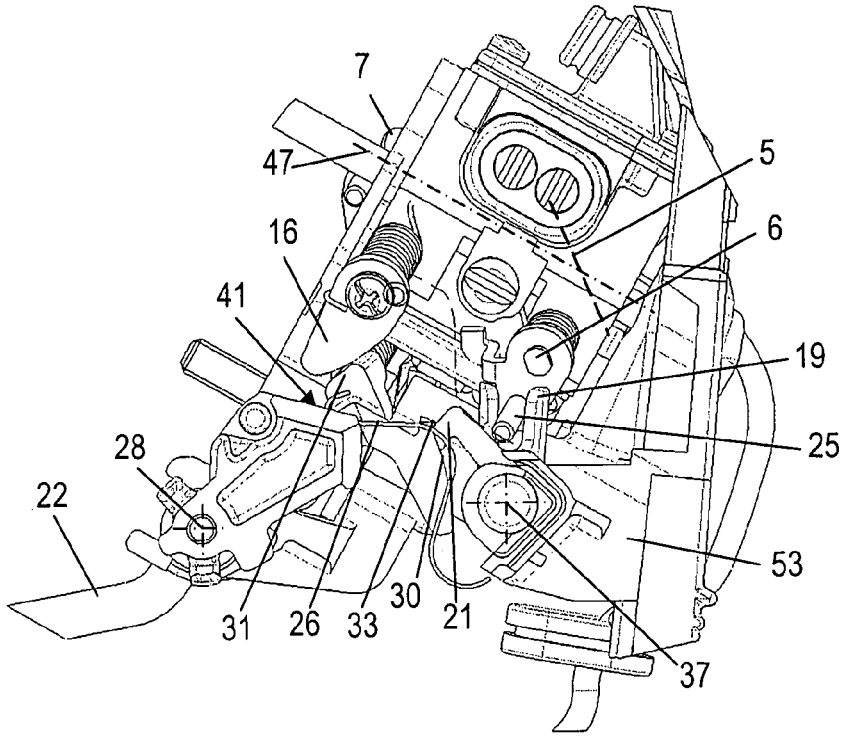
FIG. 7 is a side elevation view of the carburetor arrangement of FIG. 2 in the warm-start position.
Figure 8:
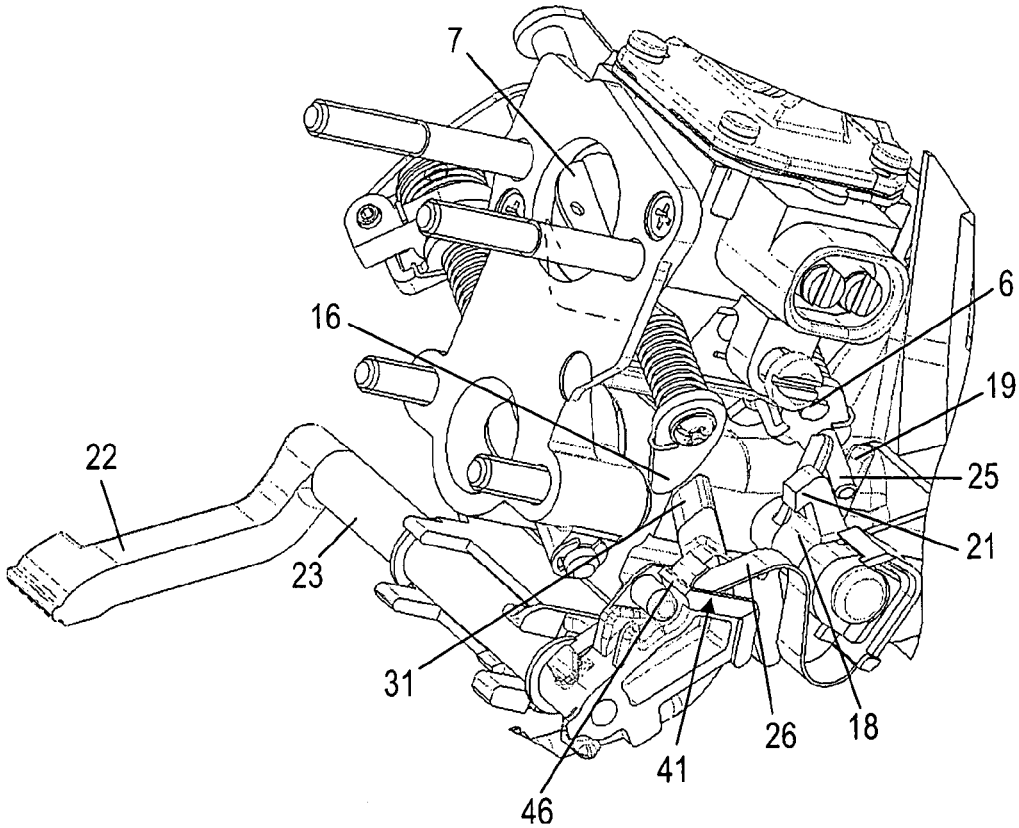
FIG. 8 is a perspective view of the carburetor arrangement of FIG. 2 in the operating position.
Figure 9:
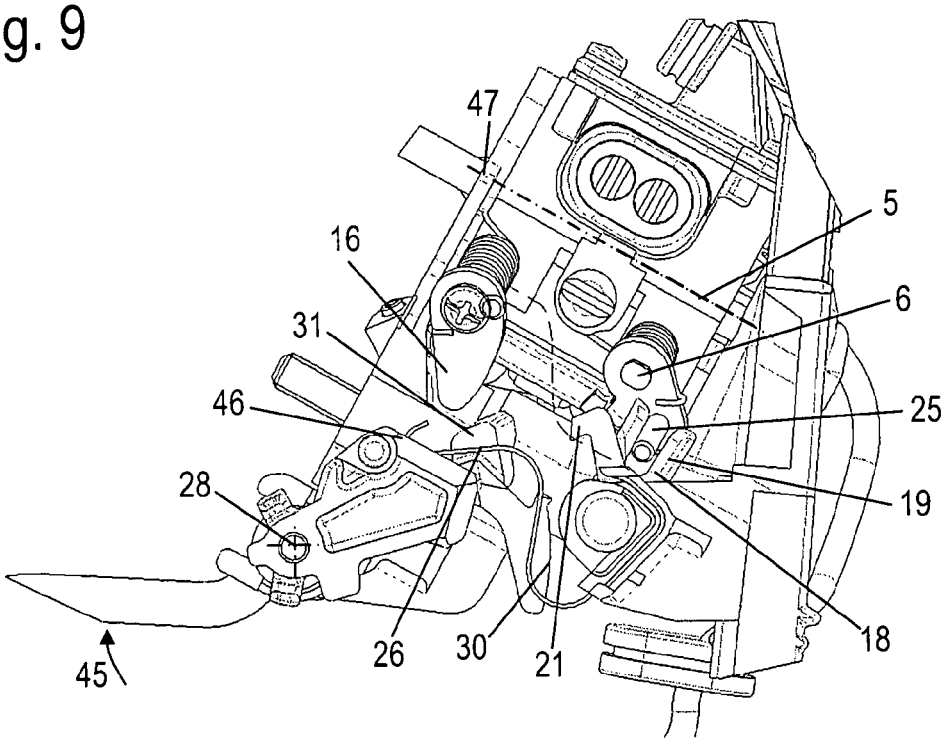
FIG. 9 is a side elevation view of the carburetor arrangement of FIG. 2 in the operating position.

To start the engine anew when the engine has already warmed up or for a start at a relatively high outer temperature, the starter unit is rotated into the warm-start position shown in FIGS. 6 and 7. Compared to the cold-start position, the operator-controlled lever 22 is rotated in the direction of arrow 44. In order to bring the starter unit into the warm-start position, the operator-controlled lever 22 must be actuated less out of the off position of the starter unit than for setting the cold-start position. As shown in FIGS. 6 and 7, the contact spring 26 lies in the warm-start position of the starter unit on a first section 41 of the slide surface 32 on the actuating lever 29. The contact spring 26 biases the actuating lever 29 in the direction of arrow 44, that is, in the direction toward the off position of the starter unit. The guide 30 has a stop 33 against which the guide piece 21 of the intermediate lever 18 lies in the warm-start position. The stop 33 runs approximately in the peripheral direction to the rotational axis 37 of the intermediate lever 18. The throttle shaft 6 is rotated with an actuation of the throttle lever. The intermediate lever 18 is pivoted in FIG. 7 in the clockwise direction about the rotational axis 37 via the pin 25 and the fork 19. In this way, the latching between the actuating lever 29 and the guide piece 21 is released.

The position of the intermediate lever 18 in the warm-start position can correspond approximately to the position of the intermediate lever in the cold-start position. Accordingly, the throttle flap 5 is in the cold-start position and in the warm-start position in almost the same position. In the warm-start position, however, the throttle flap 5 can also be slightly further open. The choke actuator 31 actuates the choke lever 16 in the warm-start position so that the choke flap 7 is partially closed. The position of the choke flap 7 is shown in FIGS. 6 and 7. In the warm-start position, the choke flap 7 is inclined to the longitudinal center axis 47 of the intake channel section 3.

After the start of the engine, the throttle lever of the engine is actuated and the throttle shaft 6 is pivoted in FIG. 7 in the counterclockwise direction. In this way, the intermediate lever 18 is pivoted in the clockwise direction and the latching between the intermediate lever 18 and the actuating lever 29 releases. The contact spring 26 pivots the actuating lever 29 about the rotational axis 28 into the operating position of the starter unit shown in FIGS. 8 and 9. The operator-controlled lever 22 pivots in the direction of the arrow 45 shown in FIG. 9. In this position, the contact spring 26 lies against an edge 46 of the slide surface 32 which separates the slide surface 32 from the contact pin 36. In this way, an unintended adjustment of the starter unit into the off position is avoided. The choke flap 7 is no longer actuated by the choke actuator 31. The choke flap 7 lies approximately parallel to the longitudinal center axis 47 in the intake channel section 3. In the full-load position of the throttle flap 5 shown in FIGS. 8 and 9, the throttle flap 5 likewise lies approximately parallel to the longitudinal center axis 47 in the intake channel section 3. With the pivoting of the throttle shaft 6, the intermediate lever 18 is entrained via the pin 25 and the fork 19. The guide piece 21 is lifted from the guide 30.

Figure 10:
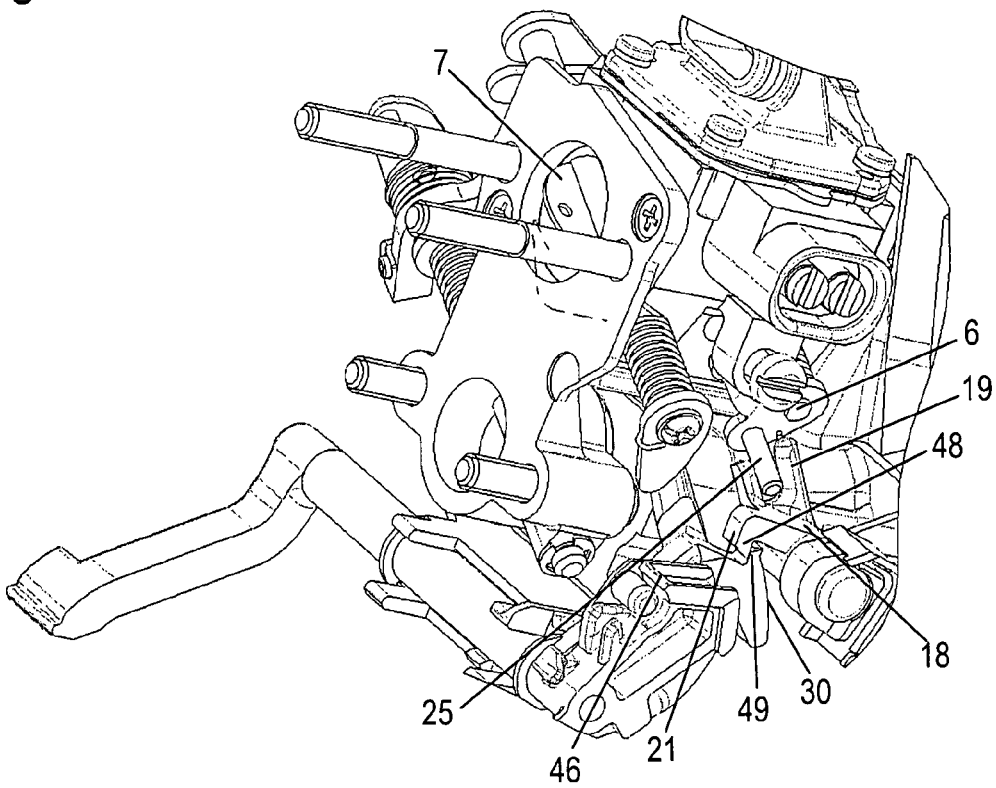
FIG. 10 is a perspective view of the carburetor arrangement of FIG. 2 with a blocked starter unit.
Figure 11:
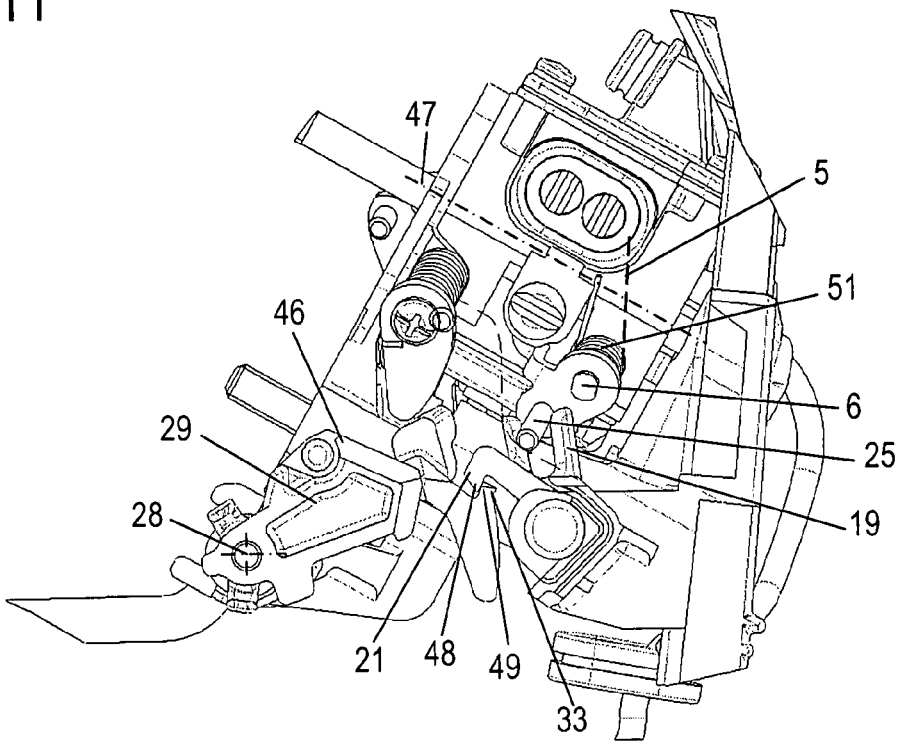
FIG. 11 is a side elevation view of the carburetor arrangement of FIG. 2 with a blocked starter unit.

FIGS. 10 and 11 show the starter unit in the safety latched state. The starter unit is in the operating position. The operator-controlled lever 22 is not pivoted compared to the full-load position shown in FIGS. 8 and 9. The contact spring 26 (not shown in FIGS. 10 and 11) lies at the edge 46 of the slide surface 32. The actuation of the throttle flap 5 had been released by the operator so that the spring 51 has brought the throttle flap 5 into its completely closed position. The throttle shaft 6 has entrained the intermediate lever 18 via the pin 25 and the fork 19 and pivoted the same in the direction toward the actuating lever 29. A latch hook 48 is formed on the guide piece 21 and latches into a latch lug 49. The latch lug 49 is formed on the rear side of the stop 33. The latch hook prevents a pivoting of the actuating lever 29 about the pivot axis 28 in the counterclockwise direction in FIG. 11. In this way, an actuation of the starter unit is avoided while the engine is still running. The latching is disengaged when the throttle shaft 6 is actuated anew.

The bowden cable 39 shown in FIG. 1 acts on the side of the carburetor housing opposite to the actuating lever 29 and is not shown in FIGS. 2 to 11. The bowden cable 39 and the starter unit can thereby be configured independently of each other.

An embodiment of a carburetor arrangement is shown in FIGS. 12 to 18. The same reference numerals used in FIGS. 1 to 11 are used here to identify the components which correspond to those in the embodiment of FIGS. 1 to 11.

Figure 12:
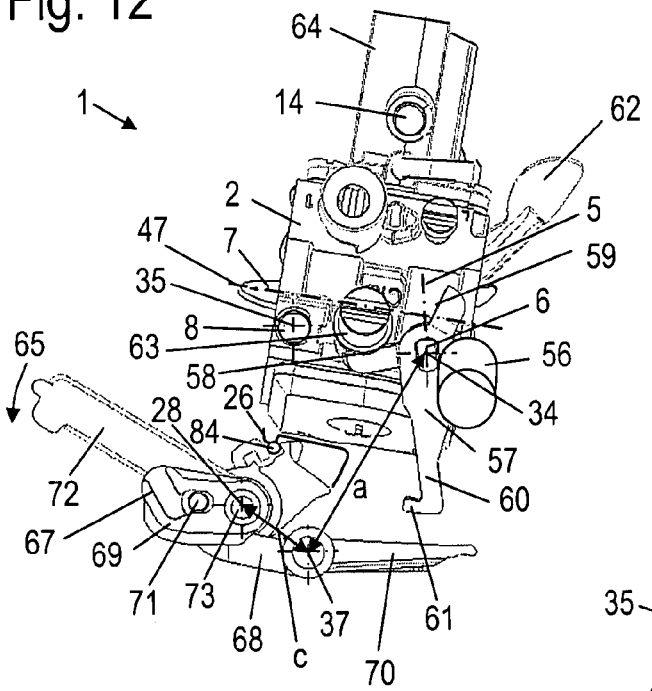
FIG. 12 is a side elevation view of an embodiment of a carburetor arrangement having a starter unit in the off position.

The carburetor shown in FIG. 12 is shown in the off position. The carburetor arrangement includes a carburetor 1 having a carburetor housing 2 wherein a throttle flap 5 having a throttle shaft 6 and a choke flap 7 having a choke shaft 8 are pivotally mounted. An air channel section 64 is fixed on the carburetor housing 2. An air flap (not shown) is pivotally supported with an air flap shaft 14 in the air channel section 64. The position of the air flap is coupled to the position of the throttle flap 5. The coupling mechanism for this purpose is mounted on the side of the carburetor housing lying to the rear in FIG. 12. The coupling mechanism includes the coupling lever 62 shown in FIG. 12 and this coupling lever is fixed to the throttle shaft 6 so as to rotate therewith and the coupling lever 62 coacts with a lever (not shown) which is fixed on the air flap shaft 14. For actuating the throttle flap 5, an actuating pin 56 is mounted on the side of the carburetor housing 2 shown forward in FIG. 12. The actuating pin 56 is fixed on a throttle lever 57 which is held on the throttle shaft 6 so as to rotate therewith. The actuating pin 56 is advantageously actuated by an actuating shaft (not shown). The actuating shaft is especially a rotating shaft which is pivotable about a rotational axis lying transversely to the rotational axis 34 of the throttle shaft 6.

In FIG. 12, the throttle flap 5 is shown schematically and by a broken line in its completely closed position. On the throttle lever 57, a first stop 58 is mounted which, in the fully closed position of the throttle flap 5, coacts with a stop pin 63 mounted on the carburetor housing 2. The stop pin 63 can be formed by a set screw of the carburetor 1. A second stop 59 is mounted on the throttle lever 57 and this stop 59 lies against the carburetor housing 2 in the completely open position of the throttle flap 5.

Figure 13:
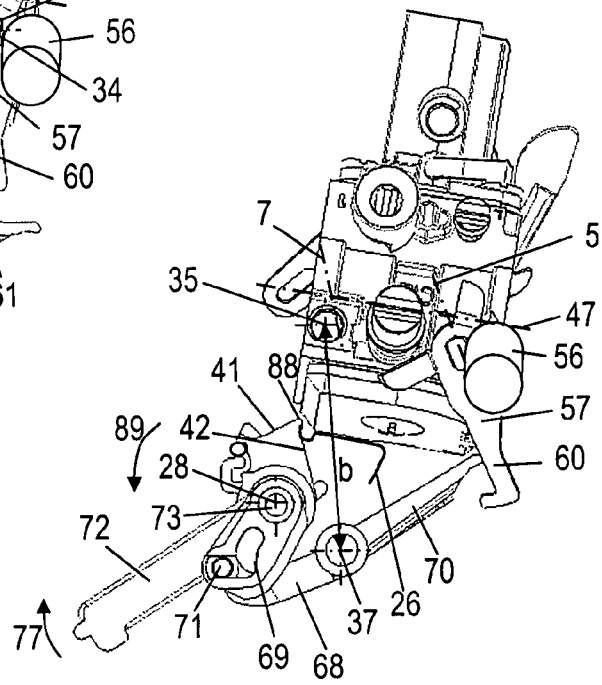
FIG. 13 is a side elevation view of the carburetor arrangement of FIG. 12 in a cold-start position.

The carburetor arrangement shown in FIG. 12 has a starter unit. The starter unit includes a control shaft 73 as well as an intermediate lever 68. The intermediate lever 68 is pivotally supported about a rotational axis 37. The rotational axis 37 is at a distance (a) to the rotational axis 34 of the throttle shaft 6. As shown in FIG. 13, the rotational axis 37 is at a distance (b) to the rotational axis 35 of the choke shaft 8. Furthermore, in FIG. 12, the distance (c) between the rotational axis 37 of the intermediate lever 68 and the rotational axis 28 of the control shaft 73 is shown. The distances (a, b, c) are given at the elevation of the intermediate lever 68 and the throttle lever 57, that is, in the plane wherein the throttle lever 57 and the section of the intermediate lever 68 are mounted with the intermediate lever 68 coacting with the throttle lever 57. The rotational axes (34, 35, 37) can be inclined with respect to each other so that the axes can intersect at a distance to the plane of the throttle lever 57.

Figure 18:
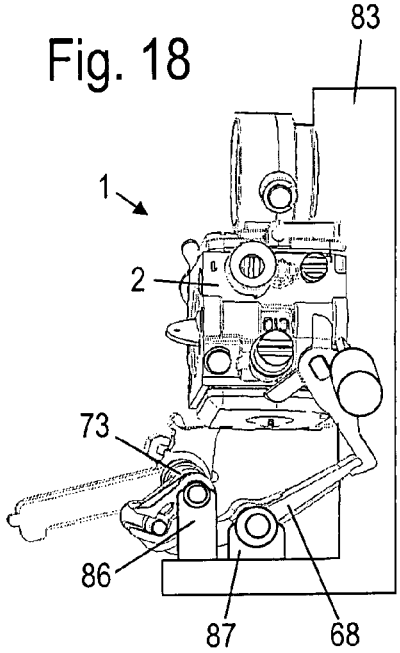

In FIG. 18, the support of the carburetor 1, the control shaft 73 and the intermediate lever 68 are shown. The carburetor 1 is held on a carburetor carrier 83. The carburetor carrier 83 can be configured as an independent component. The carburetor carrier 83 can, however, also be a section of a component of a work apparatus. For example, the carburetor carrier 83 can be at least partially configured by a housing wall. A holder 86 for the control shaft 73 is arranged on the carburetor carrier 83. Advantageously, two holders 86 are provided which engage at the two support locations 27 of the control shaft 73 shown in the perspective view in FIG. 16 and thereby reliably support the control shaft 73. For the intermediate lever 68, a holder 87 is provided which engages on the support location 75 of the intermediate lever 68 shown in FIG. 16 and pivotally supports the intermediate lever 68.

The configuration of the control shaft 73 and the intermediate lever 68 is described in the following with reference to FIG. 12 in combination with FIGS. 16 and 17. The control shaft 73 has an operator-controlled lever 72 via which the operator can adjust the control shaft 73 in different positions, namely, an off position, an operating position, a warm-start position and a cold-start position. An ignition switch 81 is mounted on the control shaft 73 next to the operator-control lever 72. The ignition switch 81 includes a contact spring 26 which is shown schematically in FIG. 17. The contact spring 26 can be fixed on the housing of the work apparatus or on the carburetor housing 2 and coacts with a contact 84 in the off position shown in FIG. 12. The contact 84 is connected via a connecting line 85 to the ground of the engine. The connecting line 85 is shown in FIG. 17. The contact spring 26 is connected to the ignition of the internal combustion engine. Only for an open ignition switch 81 can an ignition spark be generated for igniting the mixture in the combustion chamber of the engine. A slide surface 82 for the contact spring 26 is formed on the control shaft 73. The contact spring 26 slides on the slide surface 82 with the shifting between the different switch positions of the control shaft 73.

An actuating lever 69 is mounted on the control shaft 73 between the two support positions 27 of the control shaft 73. The actuating lever 69 is configured especially as one piece with the control shaft 73. As shown in FIGS. 16 and 17, the actuating lever 69 is formed as two parts. Each part of the actuating lever 69 has a guide slot 67 for accommodating a pin 71 therein. The two pins 71 are fixed on a first arm 76 of the intermediate lever 68. The movement of the intermediate lever 68 is coupled to the position of the control shaft 73 via the two pins 71 and the two guide slots 67. The intermediate lever 68 has a second arm 70 which, in the embodiment, is mounted approximately on the opposite-lying end of the rotational axis 37. Referred to the rotational axis 37, the two arms 70 and 76 lie approximately diametrically opposite each other. A stiffening strut 74 is arranged on the arm 70 in order to increase the stability thereof. The intermediate lever 68 projects in a direction parallel to the rotational axes (28, 37) beyond the control shaft 73. The bearing location 75 of the intermediate lever 68 is mounted at the projecting end next to the arm 70.

The ignition switch 81 is closed in the off position of the starter unit shown in FIG. 12. The contact spring 26 lies against the contact 84. The arm 70 of the intermediate lever 68 does not actuate the throttle lever 57. The throttle flap 5 is in the fully closed position. The bearing pins 71 lie in a region of the guide slots 67 next to the inner ends of the guide slots 67 next to the rotational axis 28.

The starter unit is shifted into the cold-start position shown in FIG. 13 in order to start the internal combustion engine at low ambient temperatures and with a cold engine. For this purpose, a throttle lever (not shown) is first actuated and the throttle flap 5 is completely opened by actuation of the actuating pin 56. Thereafter, the operator-controlled lever 72 is completely actuated in the direction of arrow 65 shown in FIG. 12. In this way, the control shaft 73 pivots in the counterclockwise direction as shown in the view of the carburetor in the FIGS. The intermediate lever 68 is also pivoted about its rotational axis 37 via the actuating lever 69 and likewise in the counterclockwise direction as shown. After the pivoting of the control shaft 73 via the operator-controlled lever 72, the throttle lever is again released by the operator so that the throttle flap 5 pivots back with the throttle lever 57. The throttle lever 57 pivots back until a coupling arm 60 of the throttle lever 57 lies against the second arm 70 of the intermediate lever 68. With the pivoting of the control shaft 73, the intermediate lever 68 is also pivoted. The pins 71 of the intermediate lever 68 then slide in the guide slots 67 of the actuating lever 69. In the cold-start position shown in FIG. 13, the pins 71 lie in a radially outer region of the guide slots 67.

Figure 16:
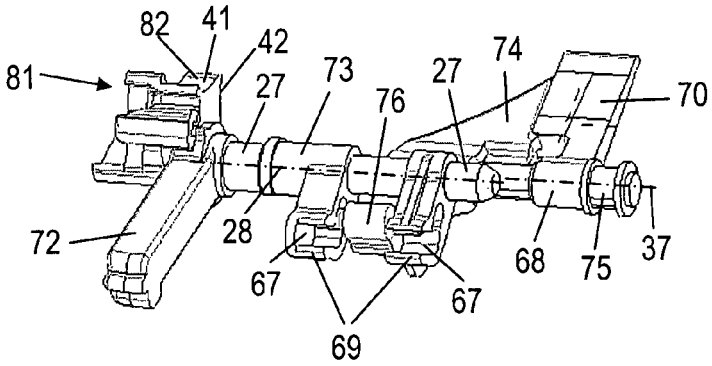
FIG. 16 is a perspective view of the control shaft and intermediate lever of the carburetor arrangement of FIGS. 12 to 15.
Figure 17:
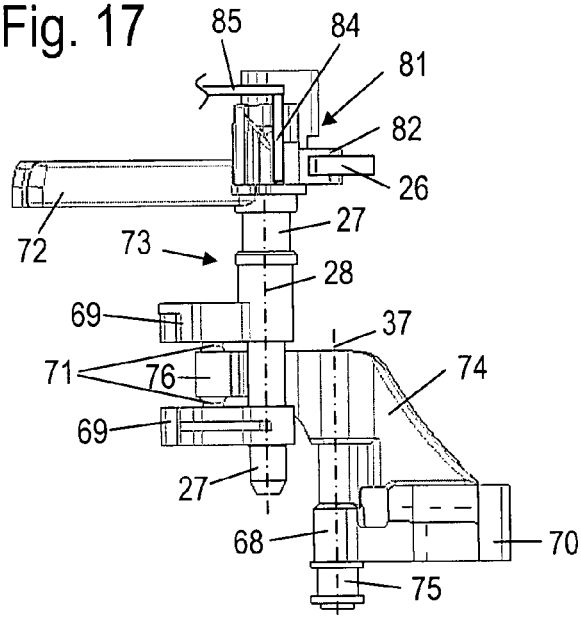
FIG. 17 is a plan view of the control shaft and the intermediate lever of FIG. 16; and, FIG. 18 is a perspective view of the carburetor arrangement of FIGS. 12 to 15 also showing a schematic of the carburetor carrier.

The slide surface 82 for the contact spring 26 has a first section 41 as well as a second section 42 (see also FIG. 16). An edge 88 is formed between the two sections 41 and 42. In the cold-start position shown in FIG. 13, the contact spring 26 lies on the second section 42 of the slide surface 82 behind the edge 88. In this way, the contact spring 26 biases the control shaft 73 in the direction of the arrow 89 shown in FIG. 13. A stop is advantageously provided against which the contact spring 26 presses the control shaft 73. In this way, the position of the control shaft 73 and of the intermediate lever 68 is fixed.

The choke flap 7 is completely opened in the cold-start position shown in FIG. 13. The throttle flap 5 is in a partially open position. The choke flap 7 is likewise actuated by the movement of the control shaft 73 via a coupling mechanism (not shown). The coupling can be provided via a choke actuation as in the embodiment shown in FIGS. 1 to 11 which is fixedly connected to the control shaft 73. The coupling can, however, also be provided via a coupling rod.

Figure 14:
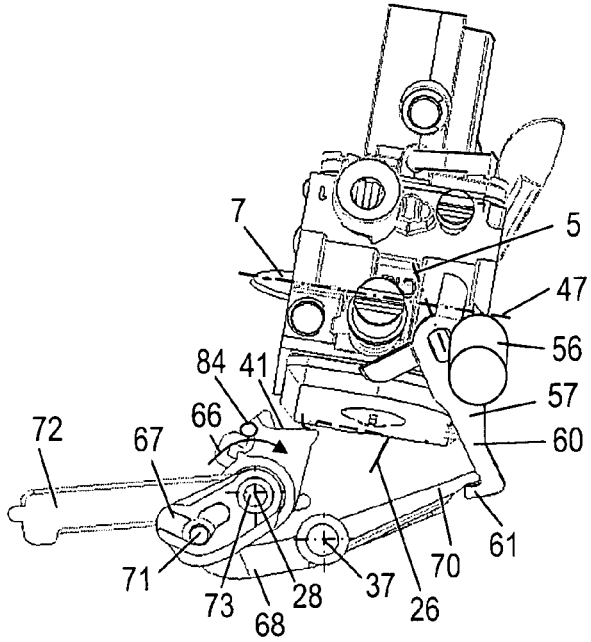
FIG. 14 is a side elevation view of the carburetor arrangement of FIG. 12 in the warm-start position.

The internal combustion engine can be started from the warm-start position shown in FIG. 14 at high ambient temperatures or when the engine is already warmed up. For this purpose, the control lever 72 is likewise shifted in the direction of arrow 65 out of the off position shown in FIG. 12; however, the control lever is shifted to a lesser extent than for the cold-start position shown in FIG. 13. From the cold-start position, the control lever 72 is shifted into the warm-start position of FIG. 14 in the direction of arrow 77 shown in FIG. 13. In the warm-start position, the contact spring 26 lies against the first section 41 of the slide surface 82. The contact spring 26 biases the control shaft 73 in the direction of the arrow 66 shown in FIG. 14, that is, in the clockwise direction.

To fix the position of the control shaft 73 and of the intermediate lever 68, a latch device is formed between the coupling arm 60 of the throttle lever 57 and the second arm 70 of the intermediate lever 68. For this purpose, the coupling arm 60 has a lug 61 at its radial outer-lying end and this lug projects in the direction toward the second arm 70 of the intermediate lever 68 and the second arm 70 of the intermediate lever 68 lies against this lug 61. In this way, the intermediate lever 68 is held in its position. The pins 71 lie in the mid region of the guide slots 67 in the warm-start position shown in FIG. 14. The mid region of the guide slot 67 is configured to have a sharp bend so that the position of the intermediate lever 68 is additionally fixed. The sharp bend in the guide slot 67 furthermore influences the kinematic of the transmission of the pivot movement of the actuating lever 69 to the intermediate lever 68. In the two regions of the guide slots 67, which are separated by the sharp bend, there results a shortening or lengthening of the transmitted operating path. The desired operating path can be obtained with a suitable configuration of the guide slots 67.

Figure 15:
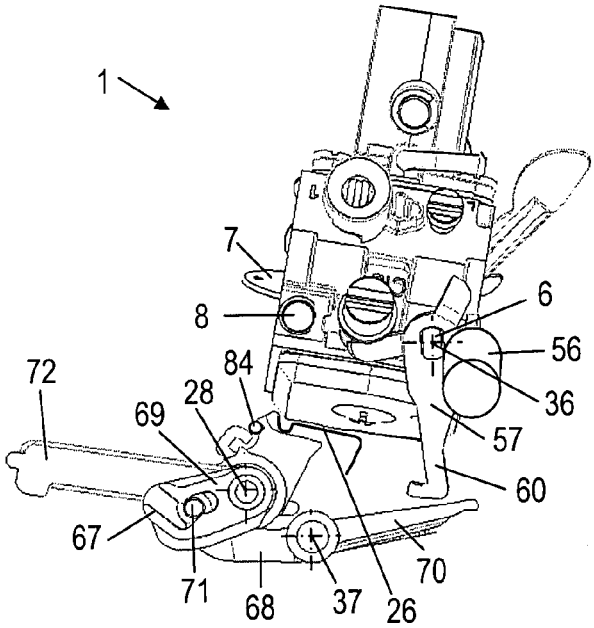
FIG. 15 is a side elevation view of the carburetor arrangement of FIG. 12 in the operating position.

The operator need simply actuate the throttle lever in order to shift the starter unit from the warm-start position shown in FIG. 14 into the operating position shown in FIG. 15. This effects a pivot movement of the throttle lever 57 in FIG. 14 in the counterclockwise direction. This pivot movement releases the lug 61 from the arm 70. Because of the spring force of the contact spring 26, the control shaft 73 and the intermediate lever 68 pivot into the operating position shown in FIG. 15. In this position, the second arm 70 of the intermediate lever 68 lies radially outside of the throttle lever 57 referred to the rotational axis 34 of the throttle shaft 6. In this way, the throttle lever 57 can be pivoted unhindered. The contact spring 26 lies against the second section 42 of the slide surface 82 and the contact spring 26 therefore especially presses against a stop formed at the end of the first section 41.

Other configurations for the intermediate levers (18, 68) can be provided.

It is understood that the foregoing description is that of the preferred embodiments of the invention and that various changes and modifications may be made thereto without departing from the spirit and scope of the invention as defined in the appended claims.

What is claimed is:

1. A carburetor arrangement for an internal combustion engine, the carburetor arrangement comprising:

a carburetor defining an intake channel;

a throttle element pivotally mounted in said intake channel to pivot about a first rotational axis;

a choke element pivotally mounted in said intake channel to pivot about a second rotational axis;

a starter unit having an off position, at least one start position and an operating position;

said starter unit determining defined positions of said throttle element and said choke element in said start position;

said starter unit including an actuating lever for actuating said starter unit;

said actuating lever defining a third rotational axis;

said starter unit further including an intermediate lever defining a fourth rotational axis;

said third rotational axis and said fourth rotational axis being at a distance (c) to each other at least at the elevation of said intermediate lever; and, said actuating lever being operatively connected to said throttle element via said intermediate lever so as to operate on said throttle element.

2. The carburetor arrangement of claim 1, wherein said fourth rotational axis is at a distance (a) to said first rotational axis; and, said fourth rotational axis is at a distance (b) to said second rotational axis.

3. The carburetor arrangement of claim 1, further comprising a carrier component and said carburetor being mounted on said carrier component; and, said actuating lever and said intermediate lever being supported on said carrier component.

4. The carburetor arrangement of claim 1, wherein said starter unit determines a warm-start position and a cold-start position of said throttle element and said choke element.

5. The carburetor arrangement of claim 1, wherein a defined position of said throttle element is assigned to each position of said intermediate lever.

6. The carburetor arrangement of claim 5, wherein said carburetor arrangement further comprises a pin connected to said throttle element; said intermediate lever comprises a bifurcated element aligned radially to said fourth rotational axis; and, said pin projects into said bifurcated element.

7. The carburetor arrangement of claim 1, wherein said actuating lever has a guide piece; and, said intermediate lever has a guide which lies on said guide piece in said start position.

8. The carburetor arrangement of claim 7, wherein said starter unit determines a warm-start position; and, said actuating lever includes a stop on which said guide piece lies in said warm-start position; and, said stop and said guide piece conjointly define a catch position.

9. The carburetor arrangement of claim 1, wherein said actuating lever has a choke actuator for acting on said choke element in said start position of said starter unit.

10. The carburetor arrangement of claim 1, wherein the position of said intermediate lever is coupled to the position of said actuating lever in every position of said intermediate lever.

11. The carburetor arrangement of claim 10, wherein said actuating lever has a guide slot formed thereon and said intermediate lever has a pin guided in said guide slot; and, the position of said intermediate lever is coupled to the position of said actuating lever via said guide pin.

12. The carburetor arrangement of claim 11, wherein said actuating lever is configured of two parts and said guide slot is disposed on both of said parts; and, said intermediate lever is coupled to said actuating lever on both sides of said intermediate lever.

13. The carburetor arrangement of claim 1, wherein said throttle element has a throttle arm connected thereto; and, said intermediate lever has an arm coacting with said throttle arm.

14. The carburetor arrangement of claim 13, wherein said starter unit has a warm-start position; said throttle arm and said arm of said intermediate lever determine a detent position in said warm-start position; and, a defined position of said throttle element is assigned to said detent position.

15. The carburetor arrangement of claim 1, wherein said internal combustion engine has an ignition system; and said carburetor arrangement further comprises a contact spring for providing an electrically conductive connection to said ignition system.

16. The carburetor arrangement of claim 15, wherein said contact spring lies on said actuating lever; and, said actuating lever has a contact element contacting said contact spring in said off position of said starter unit.

17. The carburetor arrangement of claim 15, wherein said carburetor arrangement further comprises a control shaft; said actuating lever is fixedly connected to said control shaft; and, said control shaft has a contact element for contacting said contact spring in said off position of said starter unit.

18. The carburetor arrangement of claim 15, wherein said starter unit has a warm-start position; said contact spring biases said actuating lever in said warm-start position in a direction toward said operating position; and, said actuating lever is released when said throttle element pivots in a direction toward the full-load position thereof and said starter unit pivots from said warm-start position into said operating position.

19. The carburetor arrangement of claim 15, wherein said starter unit has a cold-start position and a warm-start position; said actuating lever is biased by said contact spring opposite to the direction of movement toward said warm-start position when said actuating lever is in said cold-start position; and, said carburetor arrangement further comprises a stop defining the position of said actuating lever.

20. The carburetor arrangement of claim 1, further comprising a control shaft; and, said actuating lever being fixedly connected to said control shaft; and, said control shaft defining a rotational axis extending transversely to the flow direction in said intake channel.

21. The carburetor arrangement of claim 1, wherein said throttle element is actuated by a bowden cable which is connected to said throttle element on a side of said carburetor lying opposite said actuating lever.

22. The carburetor arrangement of claim 1, wherein said intermediate lever blocks the actuation of said starter unit in said operating position thereof and in the idle position of said throttle element.

23. The carburetor arrangement of claim 22, wherein said intermediate lever has a latch hook which coacts with a latch lug on said actuating lever in said operating position of said starter unit and in the idle position of said throttle element.

* * * * *